US005339778A

United States Patent [19]

Reckzügel et al.

[11] Patent Number: 5,339,778

[45] Date of Patent: Aug. 23, 1994

[54] CYLINDER-HEAD-MOUNTED CAMSHAFT BEARING FOR AN INTERNAL COMBUSTION ENGINE

[75] Inventors: Christoph Reckzügel, Stuttgart; Mario Mürwald, Ebersbach; Gerhard Doll, Stuttgart; Jürgen Frey, Esslingen; Ralf Ohlendorf, Weinstadt, all of Fed. Rep. of Germany

[73] Assignee: Mercedes-Benz AG, Stuttgart, Fed. Rep. of Germany

[21] Appl. No.: 105,141

[22] Filed: Aug. 12, 1993

[30] Foreign Application Priority Data

Aug. 20, 1992 [DE] Fed. Rep. of Germany ..... 4227566

[51] Int. Cl.[5] ..... F01L 1/04; F02F 1/24

[52] U.S. Cl. ..... 123/193.5; 123/90.39

[58] Field of Search ..... 123/193.5, 193.3, 90.27, 123/90.39, 90.4, 90.41, 90.42, 90.43, 90.44

[56] References Cited

U.S. PATENT DOCUMENTS 4,438,734 3/1984 Hayashi ..... 123/90.39
4,741,302 5/1988 Oda et al. ..... 123/90.44

FOREIGN PATENT DOCUMENTS 0263734 4/1988 European Pat. Off. .
3641129 7/1987 Fed. Rep. of Germany .
4117006 11/1991 Fed. Rep. of Germany .
2181486 4/1987 United Kingdom .
2193998 2/1988 United Kingdom .
2197686 5/1988 United Kingdom .
2199894 7/1988 United Kingdom .

*Primary Examiner*—Tony M. Argenbright
*Assistant Examiner*—M. Macy
*Attorney, Agent, or Firm*—Klaus J. Bach

[57] ABSTRACT

In a cylinder-head-mounted camshaft bearing structure for an internal combustion engine in which the camshaft bearings are mounted on the cylinder head by bearing caps arranged in spaced relationship from one another and the bearing caps have aligned mounting holes receiving rocker-arm support shafts for pivotally supporting the rocker arms between said bearing caps and the bearing caps are further interconnected by longitudinal webs so as to form an integral frame-like bridge unit, transverse webs are disposed between said caps in spaced relationship therefrom and interconnect the longitudinal webs so as to define between the transverse webs and between the webs and the adjacent bearing caps spaces receiving the rocker arms.

3 Claims, 2 Drawing Sheets

CYLINDER-HEAD-MOUNTED CAMSHAFT BEARING FOR AN INTERNAL COMBUSTION ENGINE

BACKGROUND OF THE INVENTION

The invention relates to a cylinder-head-mounted bearing for the camshaft of an internal combustion engine with bearing caps supported directly on the cylinder head and arranged transverse with respect to the camshaft and at a distance from one another.

U.S. Pat. No. 4,537,166 discloses a camshaft bearing with bearing caps which are firmly connected to the cylinder head by fastening bolts and which have mounting openings for the accommodation of rocker-arm shafts which extend through the bearing caps.

German Patent Publication DE 32 20 724 discloses an arrangement wherein the camshaft bearing caps are interconnected by a frame structure and support shafts for the valve rocker arms are mounted on columns projecting upwardly from the lower camshaft bearing portion mounted on the cylinder head.

The present Assignee's German Patent Publication DE 36 41 129 C1 discloses a cylinder-head-mounted camshaft bearing support structure which, although it includes a one-piece bearing mounting frame, has independent bearing caps for each bearing. Such an arrangement still requires a considerable amount of assembly work, especially since the substructure must first be fixed on the cylinder head and the individual bearing caps must then be properly positioned and mounted on the substructure.

It is the principal object of the present invention to provide a cylinder-head-mounted support arrangement for a rocker-arm support shaft which has relatively low manufacturing costs and which facilitates assembly.

SUMMARY OF THE INVENTION

In a cylinder-head-mounted camshaft bearing structure for an internal combustion engine in which the camshaft bearings are mounted on the cylinder head by bearing caps arranged in spaced relationship from one another and the bearing caps have aligned mounting holes receiving rocker-arm support shafts for pivotally supporting the rocker arms between said bearing caps and the bearing caps are further interconnected by longitudinal webs so as to form an integral frame-like bridge unit, transverse webs are disposed between said caps in spaced relationship therefrom and interconnect the longitudinal webs so as to define spaces for receiving the rocker arms between the transverse webs and the adjacent bearing caps.

The arrangement provides for an integral structure including bearing covers for all the camshaft bearings in a bank of cylinders which forms a bearing bridge unit which minimizes manufacturing and particularly assembly expenses since the expensive assembly of individual elements is eliminated during final assembly. The particular design permits quick and precise assembly of the unit on the cylinder head since the time-consuming alignment of the individual elements during assembly is eliminated. In addition, the rocker-arm shafts and the corresponding rocker-arm arrangements, e,g,, for four valves per cylinder, can be completely preassembled in a simple manner so that the bridge unit with all the control elements mounted thereon needs only to be bolted onto the cylinder head, The transverse webs extending between all the bearing caps provide for high rigidity of the bearing bridge unit, which is particularly important for the machining of the bearing bridge unit during its manufacture, that is, while it is still in the form of a casting. Rocker arms for the intake valves and at least one exhaust valve for each cylinder are provided in the spaces formed between the transverse webs, the longitudinal webs and the bearing caps. The transverse webs are preferably also provided with support holes received in the rocker-arm support shafts for providing additional support for the rocker-arm support shafts.

DESCRIPTION OF A PREFERRED EMBODIMENT

Figure 1:
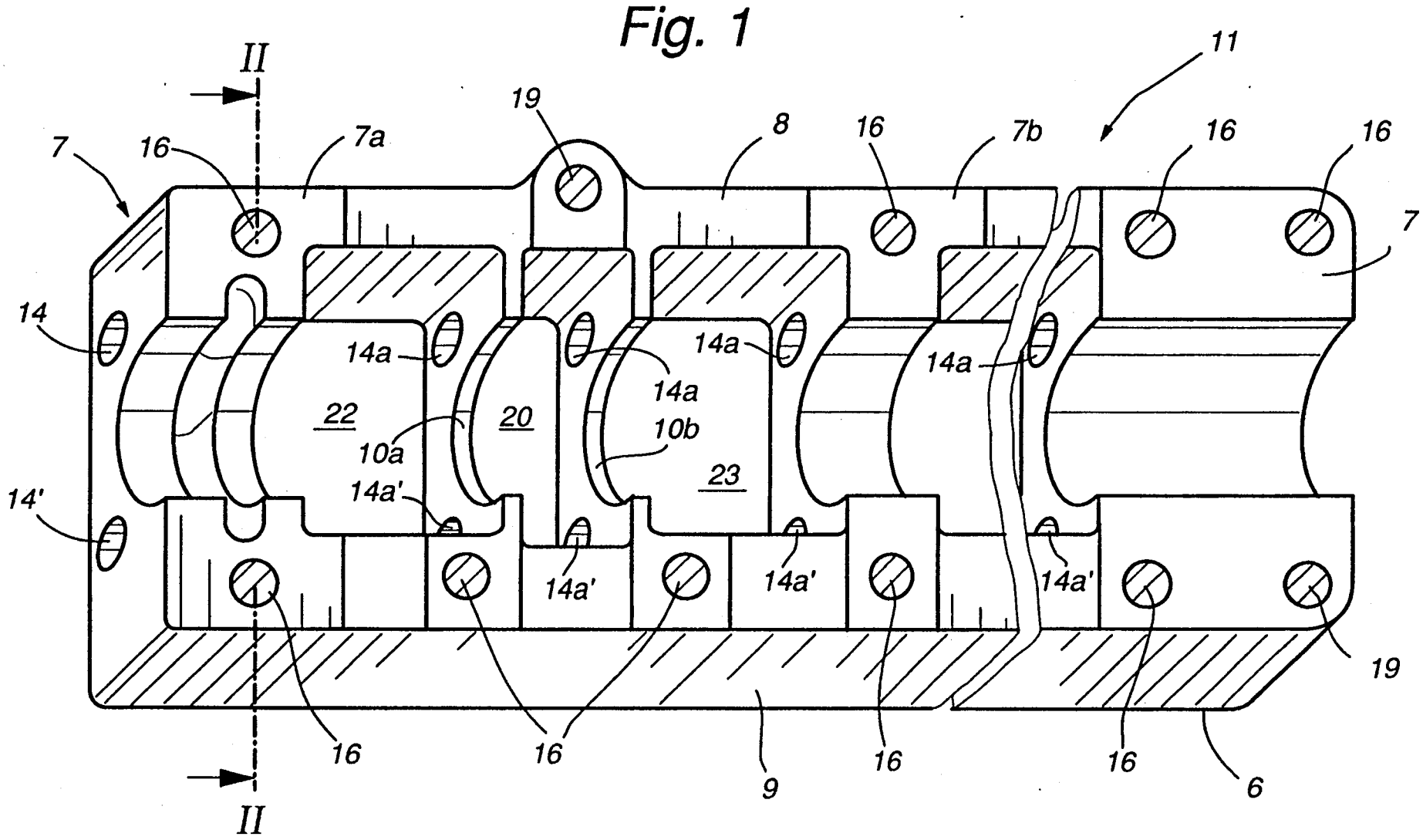
FIG. 1 is a perspective view of a camshaft bearing structure formed as an integral bridge unit.
Figure 2:
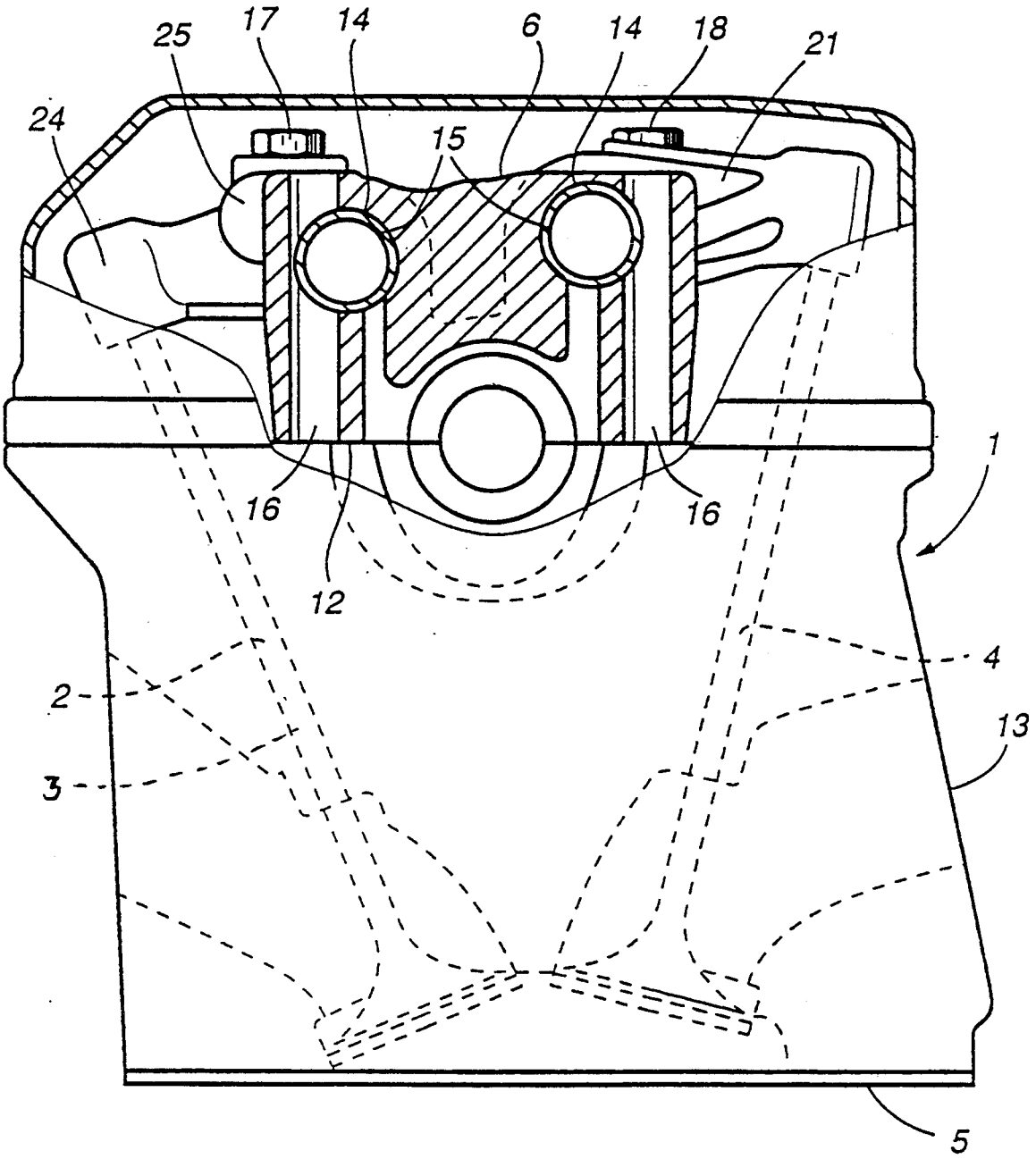
FIG. 2 is a sectional view taken along line II—II of FIG. 1.

As shown in FIG. 2 a camshaft bearing structure 6 for an internal combustion engine 1 (not shown specifically in FIG. 1) with preferably at least two intake valves 2, 3 and at least one exhaust valve 4 for each cylinder 5 comprises bearing caps 7, 7*a*, 7*b* having longitudinal webs 8, 9 as connecting elements for the bearing caps 7, 7*a*, 7*b* which are arranged in transverse planes of the cylinder head and spaced from one another, and transverse webs 10, arranged between the bearing caps 7, 7*a*, 7*b* and connected to the longitudinal webs 8, 9.

The longitudinal webs, transverse webs and bearing caps are combined to form an integral frame-like design unit or bridge unit 11 which is supported directly on the bearing surface 12 of the cylinder head 13 and is bolted firmly to the cylinder head 13. Provided in the bearing caps 7, 7*a*, 7*b*, next to the semicircular recess for receiving the camshaft, are support holes 14, 14' which extend coaxialIy to aligned hole arrangements 14*a*, 14*a'* in the transverse webs 10*a*, 10*b*. A continuous rocker-arm support shaft 15 extends through the bearing holes 14, 14' of the bearing caps 7 and through the hole arrangements 14*a*, 14*a'*. The longitudinal webs 8, 9 of the bridge unit 11 are provided with through-holes 16 for mounting bolts 17, 18 and with blind holes 19 for locating pins (not shown specifically).

Situated between adjacent bearing caps 7*a* and 7*b* are two transverse webs 10*a* and 10*b* which between them define a space 20 for the arrangement of an exhaust valve rocker arm 21 (FIG. 2) and, between the transverse web 10*a* and the bearing cap 7*a*, on the one hand, and the transverse web 10*b* and the bearing cap 7*b*, on the other hand, define further spaces 22, 23 in which intake rocker arms, specifically a primary intake valve rocker arm 24 and a secondary intake valve rocker arm 25 (FIG. 2), are disposed.

What is claimed is:

1. A cylinder-head-mounted camshaft bearing structure for an internal combustion engine with an overhead camshaft and with bearing caps for the camshaft bearings supported directly on the cylinder head, said bearing caps being arranged at a distance from one another and in planes transverse to the longitudinal extension of the cylinder head, said bearing caps having mounting holes formed therein for the accommodation of at least one rocker-arm support shaft on which rocker arms are pivotally supported between the respective bearing caps, said structure further including longitudinal webs interconnecting said bearing caps so as to form an integral frame-like bridge unit, said bridge unit having further transverse webs disposed between said caps and interconnecting said longitudinal webs so as to define spaces for receiving the rocker arms between the transverse webs and the adjacent bearing caps.

2. A camshaft bearing structure according to claim 1, wherein at least one exhaust valve and two intake valves are provided for each cylinder, and wherein two transverse webs are arranged between adjacent bearing caps and at least one exhaust valve rocker arm is received in the space formed between the transverse webs and the longitudinal webs and intake valve rocker arms are received in the spaces formed between the bearing caps and the adjacent transverse webs and the longitudinal webs.

3. A camshaft bearing structure according to claim 1, wherein said transverse webs are provided with aligned mounting holes extending coaxially with the mounting holes formed in the bearing caps for supporting said rocker-arm support shafts.

* * * * *